United States Patent [19]

Roberge et al.

[11] 4,445,082

[45] Apr. 24, 1984

[54] VARIABLE RATIO TRANSFORMER AND STATIC BALANCE COMPENSATOR

[75] Inventors: Gerald Roberge, Repentigny; Léonard Bolduc, Ste-Julie, both of Canada

[73] Assignee: Hydro Quebec, Montreal, Canada

[21] Appl. No.: 188,619

[22] Filed: Sep. 19, 1980

[30] Foreign Application Priority Data

Sep. 19, 1979 [CA] Canada ..... 335971

[51] Int. Cl.[3] ..... H01F 29/14

[52] U.S. Cl. ..... 323/206; 323/334; 323/361

[58] Field of Search ..... 323/206, 209, 248, 253, 323/332, 334, 335, 338, 355, 361, 307, 309; 336/5, 10, 11, 184, 188

[56] References Cited

U.S. PATENT DOCUMENTS 2,844,804 7/1958 Roe ..... 336/5

3,757,201 9/1973 Cornwell ..... 336/184

FOREIGN PATENT DOCUMENTS 474209 10/1937 United Kingdom ..... 336/5

OTHER PUBLICATIONS

Abstract 212, 666 [671 O.G. 1499], Feb. 23, 1951, Drawings, 4 pages, Spec. 29, pp. 1-15.

*Primary Examiner*—William H. Beha, Jr.

*Attorney, Agent, or Firm*—Schwartz, Jeffery, Schwaab, Mack, Blumenthal & Koch

[57] ABSTRACT

Variable ratio transformer constructed around a control transformer comprising: two closed magnetic circuits each constructed around a ferromagnetic core. An alternating current magnetic field circulates in the first core and a direct current magnetic field circulates in the second core. The two circuits are located so as to define at least two common magnetic spaces in which the fields are superposed orthogonally. Around the first core is wound a primary winding, a secondary winding and, for a specific application in a three-phase circuit, a tertiary winding. A conventional transformer can be associated with the control transformer to reduce the load supported by the control transformer. The variable ratio transformer according to the invention can be used as a static balance compensator.

8 Claims, 9 Drawing Figures

VARIABLE RATIO TRANSFORMER AND STATIC BALANCE COMPENSATOR

BACKGROUND OF THE INVENTION

The present invention relates to a control transformer which can be used in forming a transformer having a variable transformation ratio and in forming a static balance compensator.

More exactly, an object of the present invention is a control transformer based on the general principle of the variable inductor for one-phase or three-phase circuits described in the U.S. patent application Ser. No. 966,555 filed on Dec. 5, 1978 in the name of the applicant, now U.S. Pat. No. 4,393,157, the disclosure of which is herein incorporated by reference.

SUMMARY OF THE INVENTION

It has now been discovered that by adding to the main core of the variable inductor described in this application a supplementary winding, it was possible to considerably extend the diversity of applications of this invention particularly for three-phase circuits.

It is an object of the present invention to provide a control transformer which can be advantageously used as variable ratio transformer or which can be potentially coupled to a conventional transformer.

The above and other objects of the present invention are achieved by providing a control transformer comprising:

a first closed magnetic circuit, comprising a first ferromagnetic core through which circulates an alternating current magnetic field and which supports a primary winding having $n_1$ turns and a secondary winding having $n_2$ turns and a tertiary winding for reducing the third harmonic flux when the transformer is employed in its saturation zone;

a second closed magnetic circuit, comprising a second ferromagnetic coil, through which circulates a magnetic field produced by an adjustable direct current;

wherein said first and second magnetic circuits are located with respect to each other so as to define at least two common magnetic spaces in which the respective alternating current and direct current magnetic fields are superposed orthogonally so as to bear the magnetic dipoles of said common spaces along a direction determined by the amplitude of said direct current magnetic field of the second circuit and for controlling thus the permeability of said first alternating current magnetic circuit to said alternating current field.

In one embodiment of the invention, the control transformer can be coupled to a conventional transformer comprising $N_1$ primary turns and $N_2$ secondary turns, $N_1$ and $N_2$ being chosen such that $$\frac{N_2}{N_1} \neq \frac{n_2}{n_1}.$$

The respective primaries and secondaries are serially connected, so as to form the primary and secondary of a variable ratio transformer which can support greater loads.

This type of variable ratio transformer can be used in a three-phase circuit. In this case, one variable ratio transformer is employed for each phase. Tertiary windings can be added to the control transformers. These supplementary windings permit a reduction of the third harmonic flux when the transformer is employed in its saturation zone.

It may also be desirable to construct the three control transformers or the three conventional transformers in a single unit.

In a further preferred embodiment of the invention, specific taps are taken to the secondary of the variable ratio transformers hereinbefore described so as to constitute a static balance compensator with a very short response time.

The static balance compensator according to the invention thus comprises:

a variable ratio transformer comprising a first tap at $N_2$ turns and a second tap at $N_4$ turns, $N_4$ being lower than $N_2$, on the secondary winding of the conventional transformer, $n_1$, $n_2$, $N_1$, $N_2$ and $N_4$ being chosen so that $$\frac{N_2}{N_1} > \frac{n_2}{n_1} \text{ and } \frac{N_4}{N_1} < \frac{n_2}{n_1};$$

a capacitor connected on one end to one of the taps and on the other end to the input of the secondary of the control transformer; and an inductor connected on one end to the other tap and on the other end to the input of the secondary of the control transformer.

BRIEF DESCRIPTION OF THE DRAWINGS

The present invention will be better understood with reference to the following description of preferred embodiments, in connection with tha annexed drawings wherein:

FIG. 6 is a waveform diagram illustrating the results of an application of the compensator according to the invention.

DETAILED DESCRIPTION OF PREFERRED EMBODIMENTS

Figure 1A:
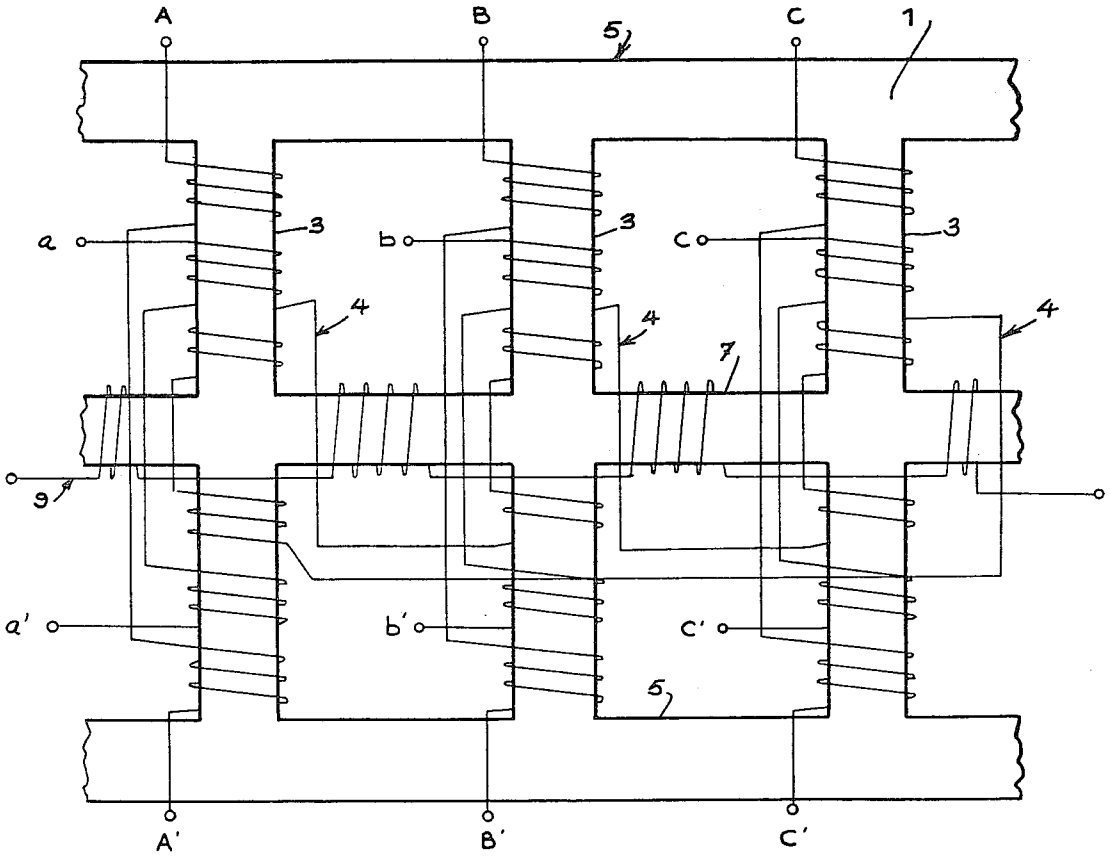
FIG. 1A is a two dimensional view of the cylindrical circumference of a control transformer for a three-phase circuit according to the invention.
Figure 1B:
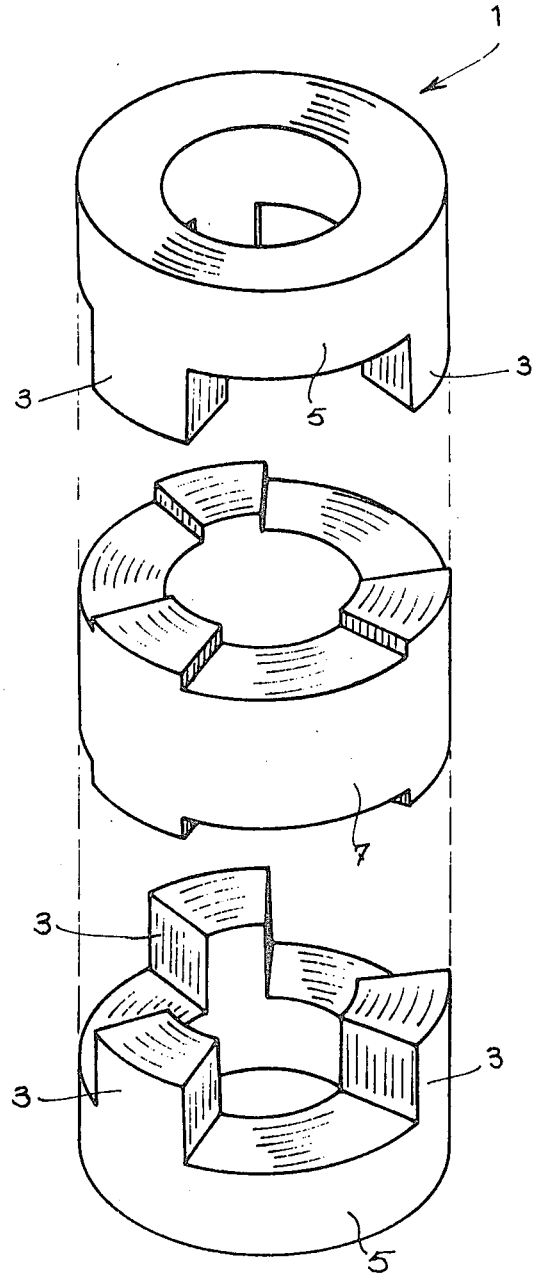
FIG. 1B is an exploded perspective view of the core of FIG. 1A.

The control transfer illustrated in FIG. 1A comprises a cylindrical core 1 of which circumference is shown in an expanded planar view for the purpose of clarification. This core 1 comprises three legs 3, two rings 5 and a control core 7 perpendicular to legs 3. Thus the plane of the paper in FIG. 1B should be curved into a cylinder. Mechanically, the core 1 can be constructed with a plurality of blocks so as to ease the construction thereof, as illustrated in FIG. 1B with full details in the copending U.S. patent application Ser. No. 966,555 hereinbefore referenced.

Figure 1C:
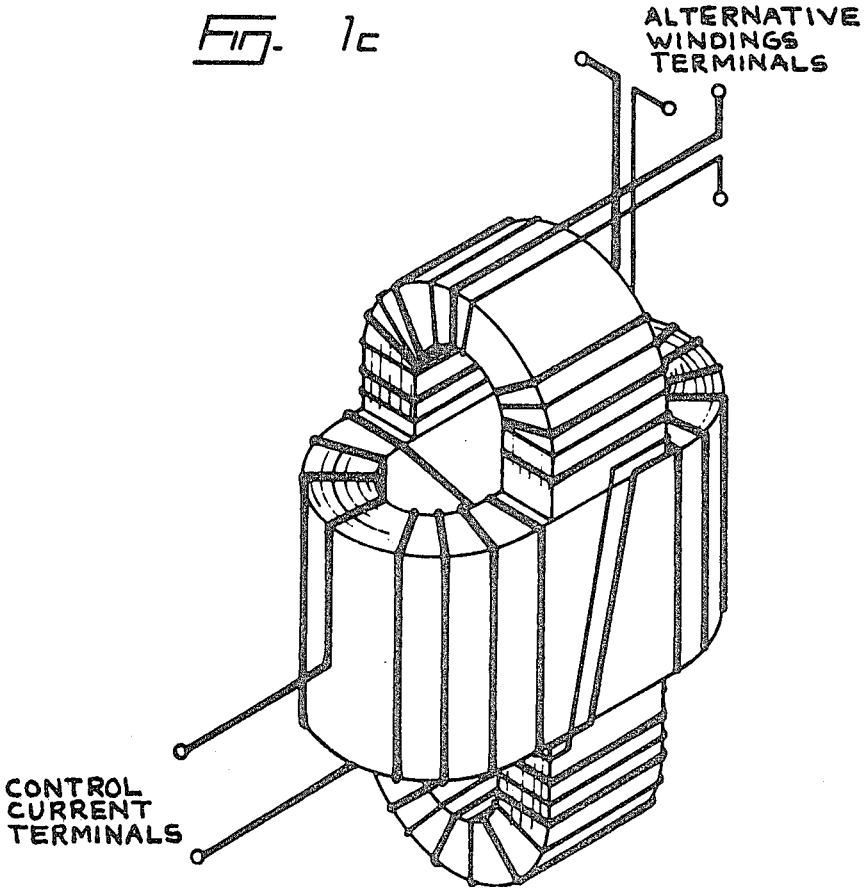
FIG. 1C is a perspective view of a single-phase control transformer to illustrate mechanical improvements.

The exact geometry of the core can be varied. However, particular characteristics will improve the performances of the transformer as shown particularly in FIG. 1C. Laminations are preferably made tangent to the rings, by superposing concentrically a series of iron sheets, for instance. The cores carrying the direct current field will preferably cut the cores carrying the alternating current field, (by making the alternating current cores in two pieces fixed to the D.C. cores, for instance) or the D.C. and A.C. cores will cut themselves mutually (in alternating the two series of sheets). The cross-section of the D.C. cores will be similar to or larger than the section of the A.C. cores.

The presence of a perforation in the area containing the common magnetic spaces will also improve the performance of the transformer.

Obviously, the absence of the above characteristics will only reduce the efficiency of the transformer, without cancelling it.

The control transformer comprises three primary windings A—A', B—B' and C—C' and three secondary windings a—a', b—b' and c—c'. Each set of primary and secondary windings is located on a respective leg 3 of the core. Each leg has also a supplemental tertiary winding 4. The three tertiary windings 4, when delta-connected, can be employed to filter the third harmonic flux, if the transformer must work in its saturation zone.

A control winding 9 is wound around the control core 7. This control transformer works similarly to the variable inductor described in the above-mentioned copending application. It is so possible to vary the inductance of the alternating current circuit and consequently the transformation ratio of the transformer by varying the current circulating in the control winding 9.

Figure 2:
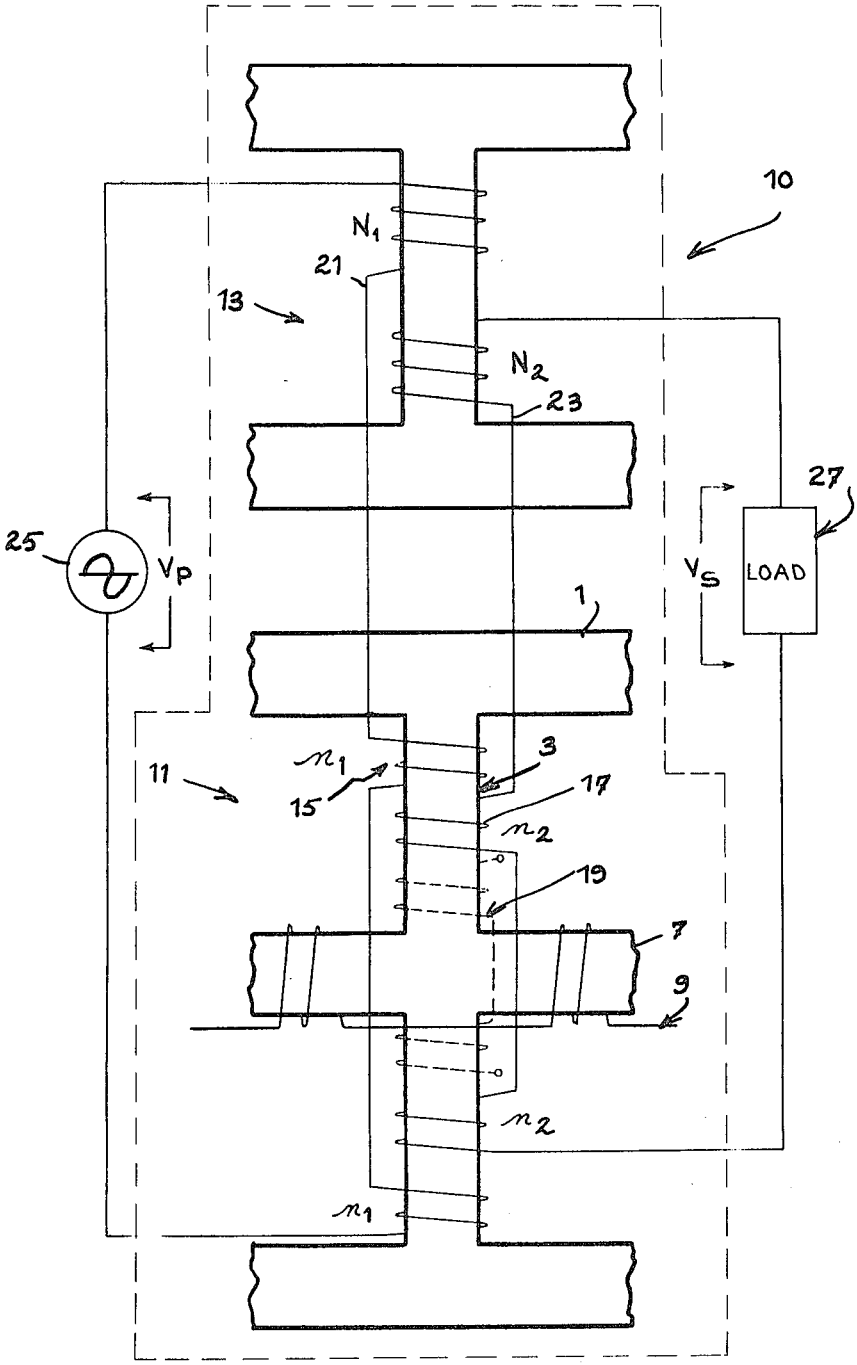
FIG. 2 is an electrical schematic of one phase of a variable ratio transformer according to the invention.

The control transformer illustrated in FIG. 1A can be used to provide a variable ratio transformer able to support high loads. Such a variable ratio transformer 10 would comprise a control transformer, as hereinbefore described, and a conventional transformer 13. For the purpose of clarification only one phase of the three-phase embodiment is illustrated in FIG. 2.

The primary 15 of the control transformer 11, comprising $n_1$ turns, is serially connected with the primary 21 of the conventional transformer 13 comprising $N_1$ turns. An alternating voltage source 25 is connected at the terminals of the primaries 15 and 21. The primary voltage Vp is measured at these terminals.

The secondary 17 of the control transformer 11, comprising $n_2$ turns, is serially connected with the secondary 23 of the conventional transformer 13, comprising $N_2$ turns. A load 27 is connected to the terminals of the secondaries 17 and 23. The secondary voltage Vs is measured.

It is to be noted that, in the case of this variable ratio transformer, it is necessary that $(N_2/N_1)$ be different from $(n_2/N_1)$. Effectively, if $(N_2/N_1)$ is equal to $(n_2/N_1)$, the control current has no effect on the load voltage.

The tertiary 19 of the control transformer 11 (shown in dotted line) can be delta-connected with the tertiary of the other phases (not shown), depending on the working range of the transformer. This connection permits a reduction of the third harmonic flux.

The control current Ic circulating in the control winding 9 is also measured.

Figure 3:
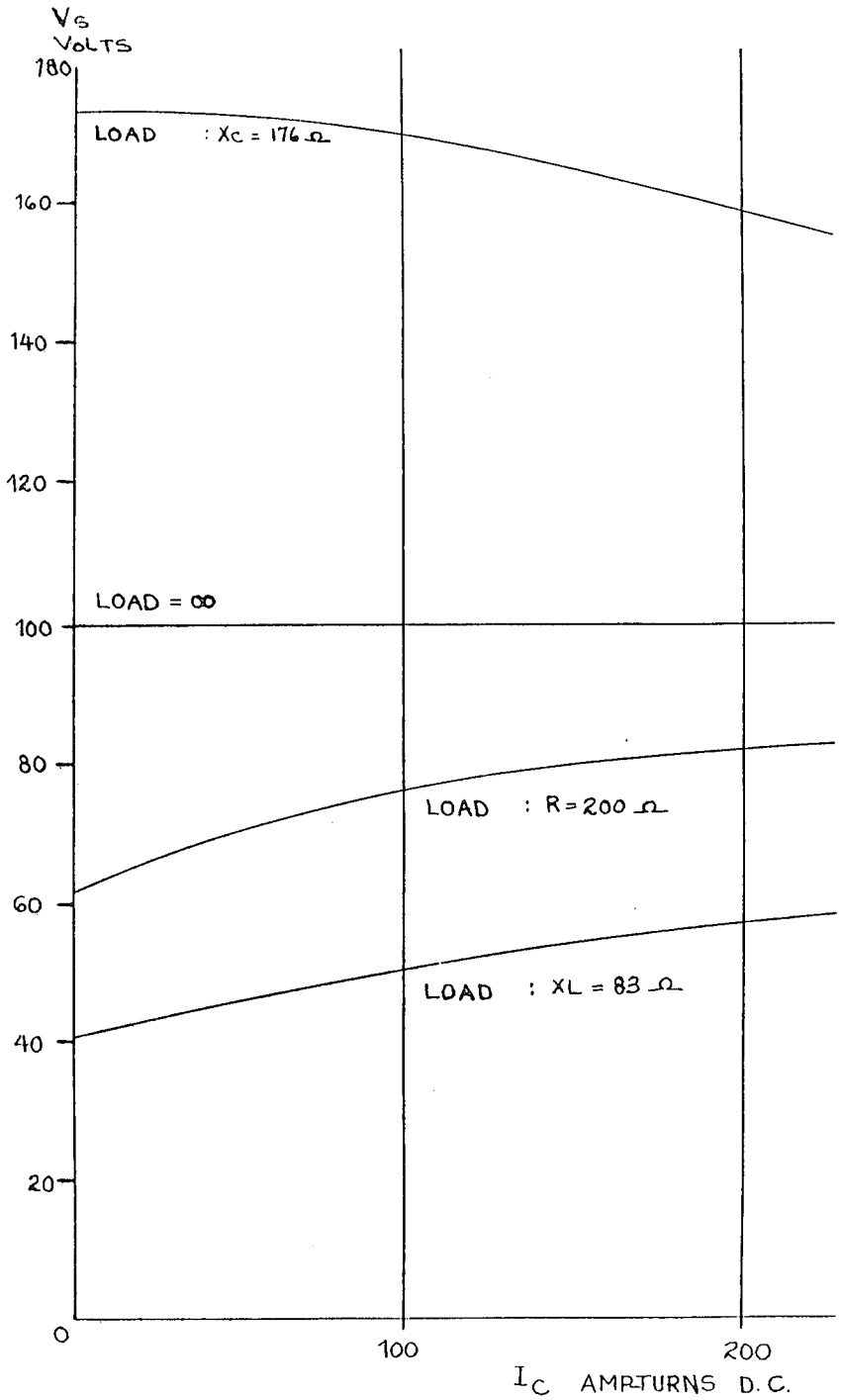
FIG. 3 is a graph of Vs and Ic in amp-turns of the variable ratio transformer illustrated in FIG. 2.

The curve of the secondary voltage Vs against the control current Ic is shown in FIG. 3 for various loads. For this Figure, a variable ratio transformer was used having the primaries star-connected with a grounded neutral and the secondaries star-connected with a floating neutral. The tertiaries were open and the experimental conditions as follows:

$$\frac{N_2}{N_1} = 1$$

$$\frac{n_2}{n_1} = 0.4$$

$n_2 = 48$
$n_1 = 120$

Saturation voltage for $N_1 = 500$ V (about)
Saturation voltage for $n_1 = 65$ V
Vp = 100 Volts
Vs measured in Volts
Ic measured in Amp-turns D.C.

As can be seen, on the curves, the voltage Vs measured on the secondary varies with the amplitude of the control current Ic. It is also to be noted that the capacitive of inductive impedance of the load ($X_c$ and $X_L$, respectively) has an influence on the direction of the variation.

Figure 4A:
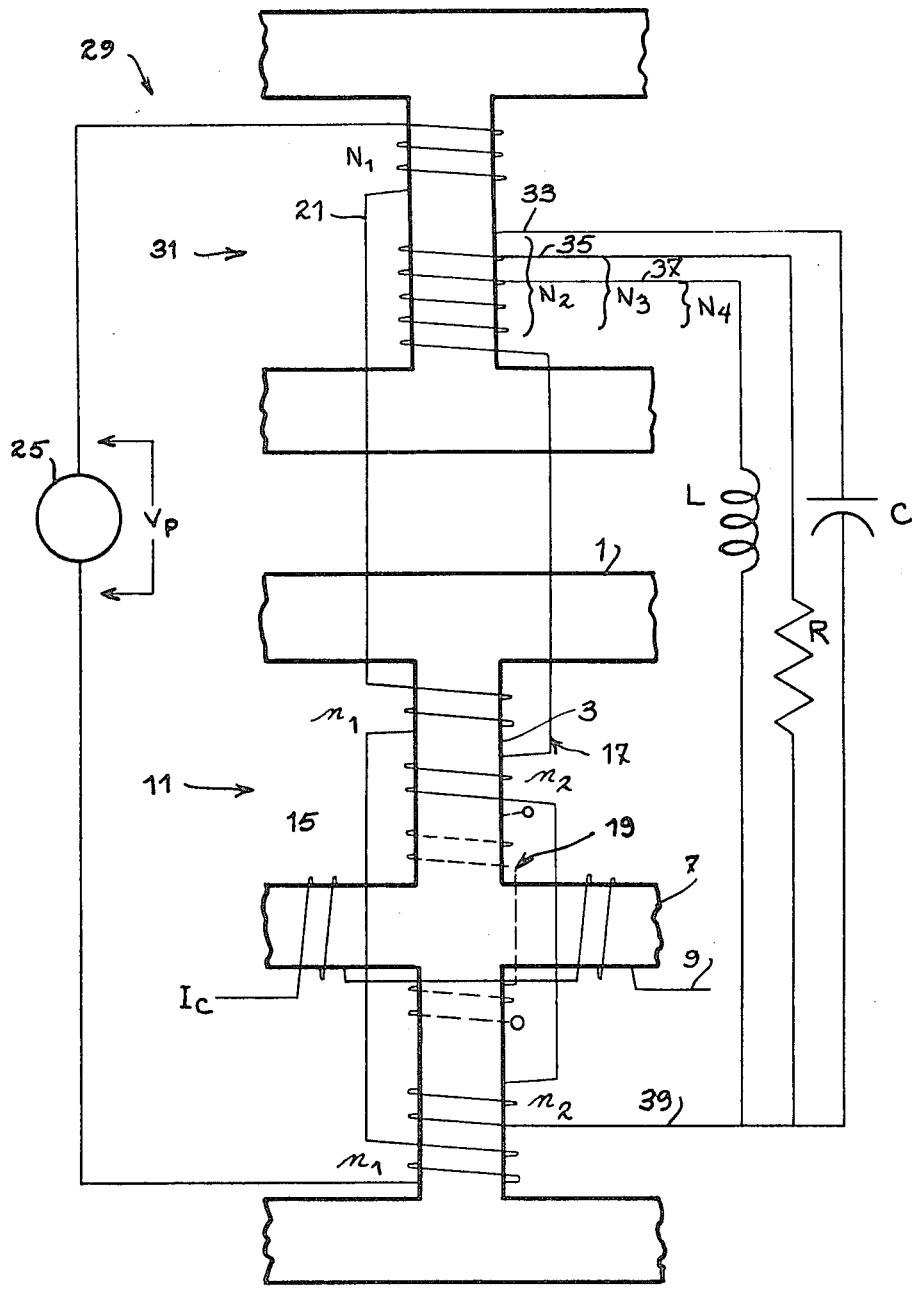
FIG. 4A is an electrical schematic of one phase of a static balance compensator according to the present invention.
Figure 4B:
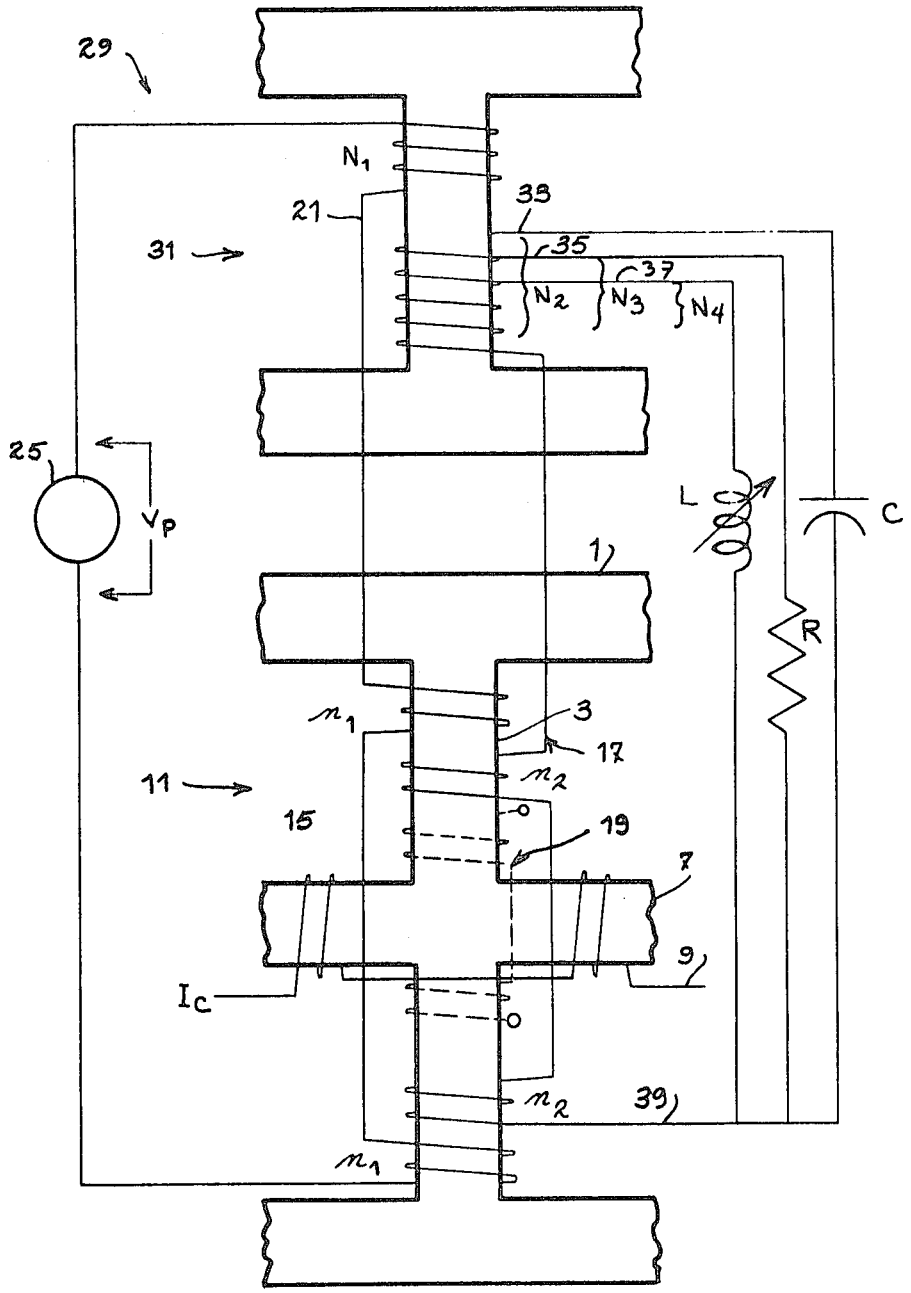
FIG. 4B is the scheme of FIG. 4A where the compensator comprises a variable inductor.

As illustrated in FIG. 4A and 4B, the variable ratio transformed described before can be used as a static balance compensator 29. The compensator 29 comprises a control transformer 11 and a conventional transformer 31 comprising a tap 33 at $N_2$ turn, a tap 35 at $N_3$ turns and a tap 37 at $N_4$ turns. A return tap 39, at the input of the secondary of the control transformer is also provided. $N_1$, $N_2$, $N_3$, $N_4$, $n_1$ and $n_2$ are chosen so as to respect the following conditions:

$$\frac{N_2}{N_1} > \frac{n_2}{n_1}, \frac{N_3}{N_1} = \frac{n_2}{n_1}, \frac{N_4}{N_1} < \frac{n_2}{n_1}$$

The inversion of the inequality signs for $N_2$ and $N_4$ is to be noted, as it permits the inversion of the action of the capacitive components in relation to the action of the inductive component. The equality in the case of $N_3$ permits insertion of a charge which is not affected by the control current.

A fixed capacitor C is connected to the tap 33 and a fixed (FIG. 4A) or variable (FIG. 4B) inductor L to the tap 37, the return being common (tap 39). By varying the amplitude of the current control in the control transformer, the capacitive current increases and the inductive current decreases, or vice versa.

Considered on the primary side, this circuit works as a capacitive or an inductive load depending on the amplitude of the control current. Depending on the required regulation range, the tertiary winding 19 may be used or not.

The tap at $N_3$ turns of the static compensator permit the connection of a load which is not affected by the control current. By this way, the compensator can also serve, in the meantime, as a power transformer.

Figure 5:
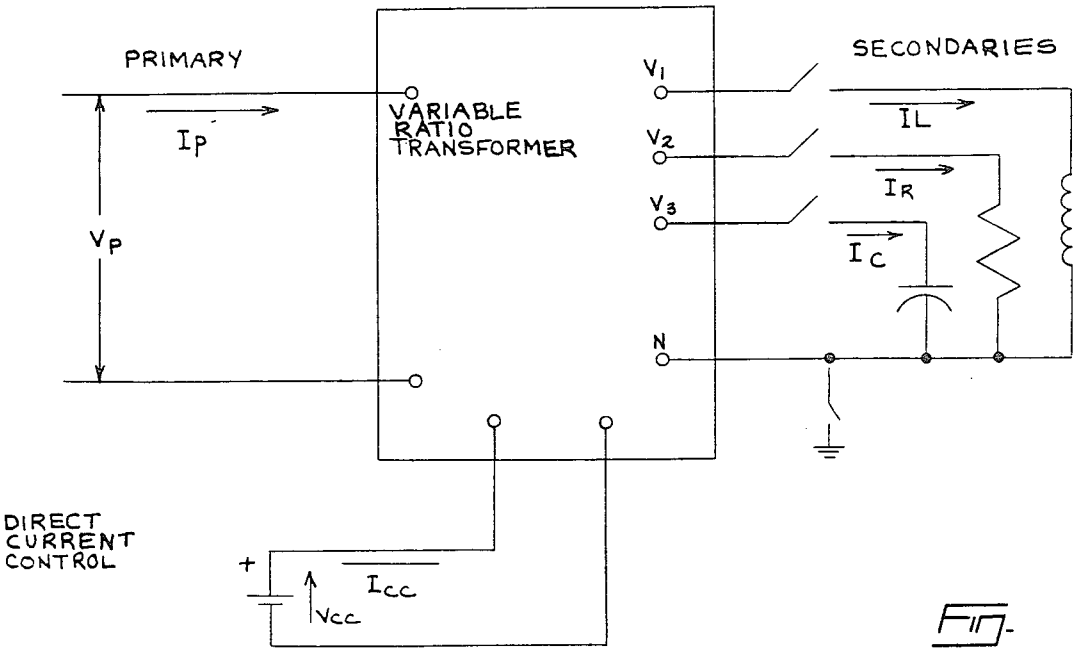
FIG. 5 is an electrical schematic of the connection to one phase of the static compensator illustrated on FIG. 4.
Figure 8:
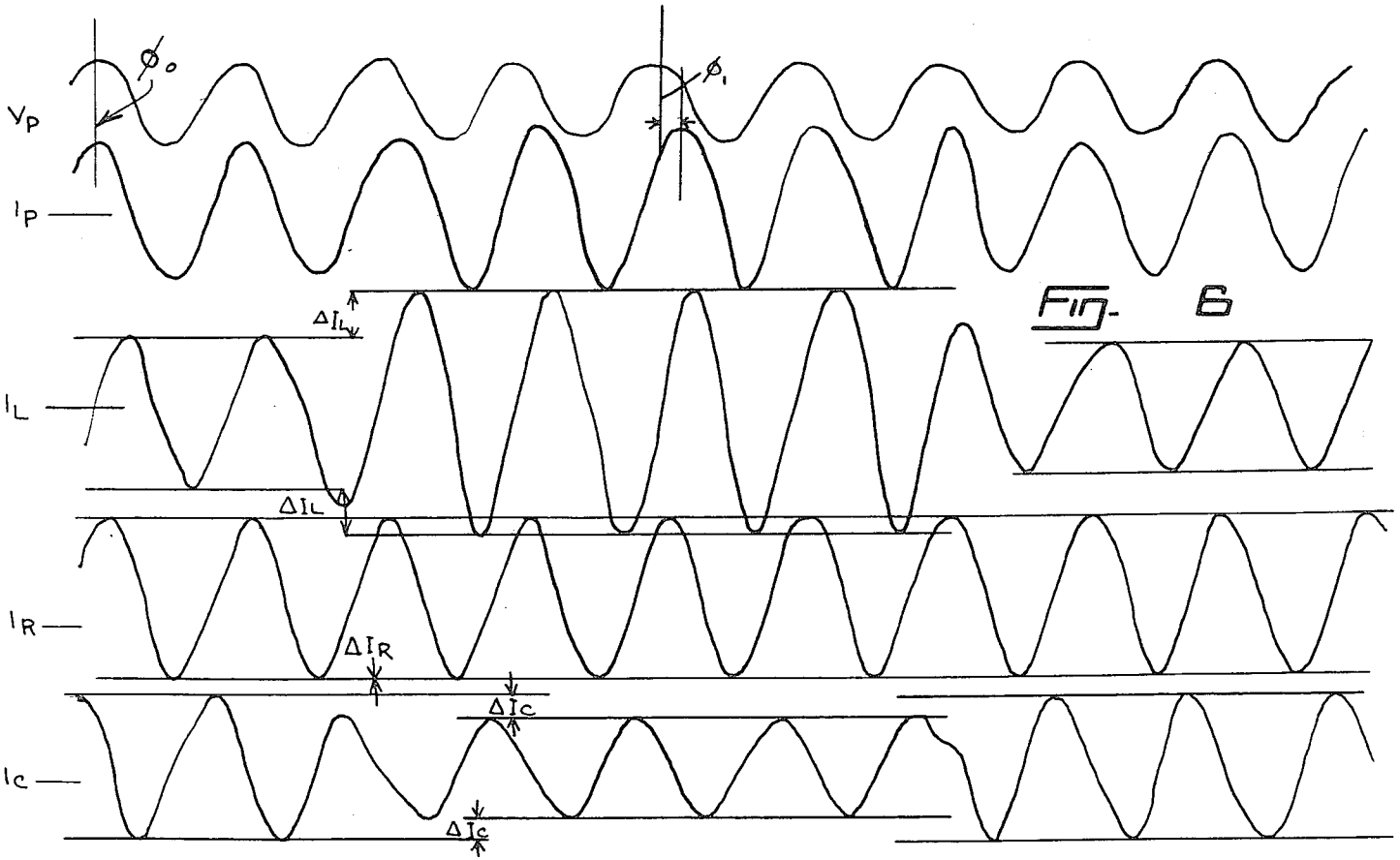

A wiring diagram illustrating the working of the static balance compensator is shown in FIG. 5 and the resultant waveforms are shown in FIG. 6. In this diagram, the variable ratio transformer is a single unit.

A voltage Vp is applied at the primary, and a current Ip is measured. The direct curent Icc supplied by a source Vcc is applied to a control winding. On the secondary side, taps $V_1$, $V_2$, $V_3$ and N correspond to taps 33, 35, 37 and 39 of the circuit of FIG. 4. A current $I_L$ circulates through the inductor, a current Ir through the resistive load R and a current Ic through the capacitor C.

A voltage pulse is applied to a source Vcc, supplying the control current for a duration of approximately 5 cycles. The following results were recorded.

| | |
|---|---|
| Response time: | 1 cycle |
| Increase of the inductive load current: | 70% |
| Variation of the resistive load current: | 0% |
| Reduction of the capacitive load current: | 35% |
| Modification of the power factor angle Ø: | 0 to 35° retarded |

As can be seen, when the step is applied, the inductive current $I_L$ and capacitive current Ic changes immediately, thus resulting in a variation of the power factor angle.

Additionally, it can be seen that the current Ir of the resistive load did not change. It is thus possible to use the same apparatus simultaneously as a compensator and as a power transformer.

Although the invention has been described relative to a specific embodiment thereof, it is not so limited and many modifications and variations thereof will be readily apparent to those skilled in the art in light of the above teachings. It is, therefore, to be understood that, within the scope of the appended claims, the invention may be practiced otherwise than as specifically described.

The embodiments of the invention in which an exclusive property or privilege is claimed are defined as follows:

1. A variable ratio transformer comprising:

a conventional transformer including a primary winding of $N_1$ turns and a secondary winding of $N_2$ turns; and a control transformer comprising:

a first closed magnetic circuit comprising a first ferromagnetic core through which an alternating current magnetic field circulates;

primary and secondary windings supported by said first ferromagnetic core, said primary winding having $n_1$ turns and said secondary winding having $n_2$ turns;

a second closed magnetic circuit commprising a second ferromagnetic core through which an adjustable direct current magnetic field circulates;

wherein said first and second magnetic circuits are located with respect to each other so as to define at least two common magnetic spaces in which the respective alternating and direct current magnetic fields are superposed orthogonally so as to orient the magnetic dipoles of said common spaces along a direction determined by the amplitude of said direct current magnetic field of the second circuit and for controlling the permeability of said first alternating magnetic circuit to said alternating field; and wherein said primary winding of said control transformer is connected in series with said primary winding of said conventional transformer and said secondary winding of said control transformer is connected in series with the secondary winding of said conventional transformer, said primary and secondary windings of said conventional and control transformers being chosen such that the ratio $(N_2/N_1)$ is different from the ratio $(n_2/n_1)$, said primary and secondary windings forming together the primary and secondary windings of said variable ratio transformer, said ratio being controlled by said direct current forming said direct current magnetic field.

2. The variable ratio transformed according to claim 1, wherein said variable ratio transformer is adapted for a three-phase circuit with three conventional transformers and three control transformers, one conventional transformer and control transformer pair for each phase of said three-phase circuit.

3. The variable ratio transformer of claim 2, wherein each of said three control transformers includes tertiary windings supported by said first ferromagnetic core, the three tertiary windings being delta-connected.

4. The variable ratio transformer according to claim 3, wherein said first ferromagnetic core of each of said three control transformers comprises a single core upon which all windings of said three control transformers are wound.

5. The variable ratio transformer according to either claim 3 or claim 4, wherein said three conventional transformers comprise a single unit.

6. A static balance compensator including a variable ratio transformer comprising:

a conventional transformer including a primary winding of $N_1$ turns and a secondary winding of $N_2$ turn; and a control transformer comprising:

a first closed magnetic circuit comprising a first ferromagnetic core through which an alternating current magnetic field circulates;

primary and secondary windings supported by said first ferromagnetic core, said primary winding having $n_1$ turns and said secondary winding having $n_2$ turns;

a second closed magnetic circuit comprising a second ferromagnetic core through which an adjustable direct current magnetic field circulates;

wherein said first and second magnetic circuits are located with respect to each other so as to define at least two common magnetic spaces in which the respective alternating and direct current magnetic fields are superposed orthogonally so as to orient the magnetic dipoles of said common spaces along a direction determined by the amplitude of said direct current magnetic field of the second circuit and for controlling the permeability of said first alternating magnetic circuit to said alternating field;

wherein said primary winding of said control transformed is connected in series with said primary winding of said conventional transformer and said secondary winding of said control transformer is connected in series with the secondary winding of said conventional transformer, said primary and secondary windings of said conventional and control transformers being chosen such that the ratio $(N_2/N_1)$ is different from the ratio $(n_2n_1)$, said primary and secondary windings forming together the primary and secondary windings of said variable ratio transformer, said ratio being controlled by said direct current forming said direct current magnetic field; and said variable ratio transformer including on the secondary winding of said conventional transformer, a first tap at $N_2$ turns and a second tap at $N_4$ turns, $N_4$ being less than $N_2$, and $n_1$, $n_2$, $N_1$, $N_2$, and $N_4$ being chosen shuch that $$\frac{N_2}{N_1} > \frac{n_2}{n_1} \text{ and } \frac{N_4}{N_1} < \frac{n_2}{n_2};$$

said conventional transformer includes:

a capacitor connecting one of said taps to the secondary winding of said control transformer; and an inductor connecting the other of said taps to the secondary of said control transformer.

7. The static balance compensator according to claim 6, wherein said variable ratio transformer includes a third tap at $N_3$ turns on said secondary winding of said conventional transformer, $N_3$ being between $N_2$ and $N_4$ with $N_3$ being chosen in accordance with the equation $$\frac{N_3}{N_1} = \frac{n_2}{n_1}.$$

8. The static balance compensator in accordance with either claim 6 or claim 7, adapted for a three-phase circuit wherein there are three distinct variable ratio transformers one variable ratio transformer for each phase of said three-phase circuit, each of said three control transformers further including a tertiary winding, said tertiary windings of said three control transformers being delta-connected.

* * * * *

UNITED STATES PATENT AND TRADEMARK OFFICE

CERTIFICATE OF CORRECTION

PATENT NO. : 4,445,082

DATED : April 24, 1984

INVENTOR(S) : Gerald ROBERGE

It is certified that error appears in the above—identified patent and that said Letters Patent is hereby corrected as shown below:

The identification of the inventor on the cover page of the patent should read:

[75] Inventor: Gerald Roberge, Repentigny, Canada

Signed and Sealed this

*Twelfth* Day of *March 1985*

[SEAL]

*Attest:*

DONALD J. QUIGG

*Attesting Officer* *Acting Commissioner of Patents and Trademarks*